US008169151B2

(12) United States Patent
Kimura

(10) Patent No.: US 8,169,151 B2
(45) Date of Patent: May 1, 2012

(54) DC/AC CONVERTER AND CONTROLLER THEREOF

(75) Inventor: Kengo Kimura, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 416 days.

(21) Appl. No.: 12/558,908

(22) Filed: Sep. 14, 2009

(65) Prior Publication Data

US 2010/0066261 A1 Mar. 18, 2010

(30) Foreign Application Priority Data

Sep. 18, 2008 (JP) ..... 2008-239555

(51) Int. Cl.
*H05B 41/16* (2006.01)
*H05B 41/24* (2006.01)

(52) U.S. Cl. ..... 315/246; 315/224; 315/291; 315/310; 315/311

(58) Field of Classification Search ..... None
See application file for complete search history.

(56) References Cited

U.S. PATENT DOCUMENTS 6,703,796 B2 * 3/2004 Che-Chen et al. ..... 315/291
7,239,091 B2 * 7/2007 Shinmen et al. ..... 315/224
2009/0212712 A1 * 8/2009 Endres ..... 315/250

FOREIGN PATENT DOCUMENTS

JP 2007-123010 5/2007

OTHER PUBLICATIONS

U.S. Appl. No. 12/561,765, filed Sep. 17, 2009, Kimura, et al.

* cited by examiner

*Primary Examiner* — Anh Tran
(74) *Attorney, Agent, or Firm* — Oblon, Spivak, McClelland, Maier & Neustadt, L.L.P.

(57) ABSTRACT

A DC/AC converter includes a resonant circuit having a first capacitor connected to at least one of a primary winding and a secondary winding of a transformer and an output end connected to a load, the resonant circuit receiving an alternating signal having a predetermined frequency and amplitude to pass a current, a variable impedance element connected in parallel with a part of the output end of the resonant circuit, the variable impedance element changing the impedance value thereof according to a current passing through the load, and a controller to control the current passing through the load to a predetermined value by changing the resonant frequency of the resonant circuit according to the changed impedance value of the variable impedance element.

7 Claims, 4 Drawing Sheets

DC/AC CONVERTER AND CONTROLLER THEREOF

BACKGROUND OF THE INVENTION

1. Field of the Invention

The present invention relates to a compact and low-cost DC/AC converter to supply power to a plurality of loads and a controller for the DC/AC converter.

2. Description of the Related Art

An example of a DC/AC converter is disclosed in Japanese Unexamined Patent Application Publication No. 2007-123010. This related art is a discharge lamp lighting apparatus for lighting a discharge lamp such as a cold cathode fluorescent lamp (CCFL). The apparatus controls necessary power for the discharge lamp by monitoring a load current passing through the discharge lamp, and according to the monitored load current, modulating the oscillation frequency of a switching network of an inverter circuit, i.e., a DC/AC converter arranged in the apparatus.

FIG. 1 illustrates the discharge lamp lighting apparatus 1000 according to the above-mentioned related art. The apparatus 1000 includes a DC power source 200, the inverter circuit 300, and a discharge current monitor 400. The oscillation frequency of the inverter circuit 300 is controllable. The inverter circuit 300 receives a DC voltage from the DC power source 200, converts the DC voltage into a high-frequency voltage having the oscillation frequency of the inverter circuit 300, and uses the high-frequency voltage to drive, through a coupling capacitor 105, a load circuit L100. The load circuit L100 includes a series resonant circuit and the discharge lamp 107, the series resonant circuit consisting of a resonant capacitor 108 and a resonant inductor (choke coil) 106, the discharge lamp 107 being connected in parallel with the resonant capacitor 108.

When the inverter circuit 300 oscillates at a predetermined frequency to convert the DC voltage into the high-frequency voltage, the discharge current monitor 400 controls the oscillation frequency of the inverter circuit 300. The discharge current monitor 400 includes a current transformer 109 having an output winding that provides an output according to a discharge current of the discharge lamp 107 and a lighting detector Lop100 to detect the presence and magnitude of the discharge current of the discharge lamp 107 according to the output from the current transformer 109.

In the discharge lamp lighting apparatus of the related art illustrated in FIG. 1, the discharge current monitor 400 monitors a discharge current of the discharge lamp 107, and according to the monitored discharge current, controls the oscillation frequency of the inverter circuit 300 and lights the discharge lamp 107.

SUMMARY OF THE INVENTION

When lighting a plurality of discharge lamps, the discharge lamp lighting apparatus of the related art must provide each discharge lamp with a transformer (the current transformer 109) to monitor a load current passing through the discharge lamp.

In addition, the related art must control the oscillation frequency of the inverter circuit based on each load current passing through each discharge lamp. This complicates the circuit for controlling the switching network of the inverter circuit and increases the size and cost of the DC/AC converter, i.e., the discharge lamp lighting apparatus.

The present invention provides a DC/AC converter that is compact and low cost and a controller for a DC/AC converter.

According to an aspect of the present invention, the DC/AC converter includes a resonant circuit having a first capacitor connected to at least one of primary and secondary windings of a transformer and an output end connected to a load, the resonant circuit being configured to receive an alternating signal having a predetermined frequency and amplitude to provide a current; a variable impedance element connected in parallel with a part of the output end of the resonant circuit, the variable impedance element being configured to change the impedance value thereof according to a current passing through the load; and a controller configured to control the current passing through the load to a predetermined value by changing the resonant frequency of the resonant circuit according to the changed impedance value of the variable impedance element.

According to another aspect of the present invention, the controller for a DC/AC converter includes a detection unit configured to detect an electric characteristic of a load; a comparator configured to compare the detected electric characteristic with a reference value and find an error between them; a variable impedance element connected in parallel with a part of an output end of a resonant circuit that includes a transformer, capacitors, and the output end to which the load is connected; and a control part configured to change the impedance value of the variable impedance element according to the error provided by the comparator, change the resonant frequency of the resonant circuit according to the impedance value, and thereby control a current passing through the load to a predetermined value.

According to the present invention, the controller changes the resonant frequency of the resonant circuit according to a changed impedance value of the variable impedance element, to thereby control a current passing through the load to a predetermined value. Namely, the present invention controls power necessitated by the load by changing the resonant frequency of the resonant circuit. With this, a plurality of switching elements (a switching network) provided for the DC/AC converter can simply oscillate at a predetermined frequency and duty without an exclusive PWM feedback controller.

This allows the DC/AC converter to commonly use switching drive signals used by a half-bridge AC-DC power source that supplies DC power to a microcomputer installed in an LCD system in which the DC/AC converter is used as a discharge lamp lighting apparatus. Commonly using the switching drive signals results in simplifying the controller of the DC/AC converter and reducing the size and cost of the DC/AC converter.

If varying the resonant frequency of the resonant circuit is achieved by connecting a resistance component in series with the load (discharge lamp), an effective power loss will increase. To avoid this, the present invention carries out apparent power control by varying an equivalent component of a second capacitor connected in parallel with the load, thereby efficiently lighting the discharge lamp (load).

DESCRIPTION OF THE PREFERRED EMBODIMENT

A DC/AC converter according to an embodiment of the present invention will be explained in detail with reference to the drawings.

Unlike the related art that employs a resonant circuit whose resonant frequency is fixed and a switching network whose oscillation frequency is variable, the present invention employs a resonant circuit whose resonant frequency is variable and a switching network whose oscillation frequency is fixed.

Figure 1:
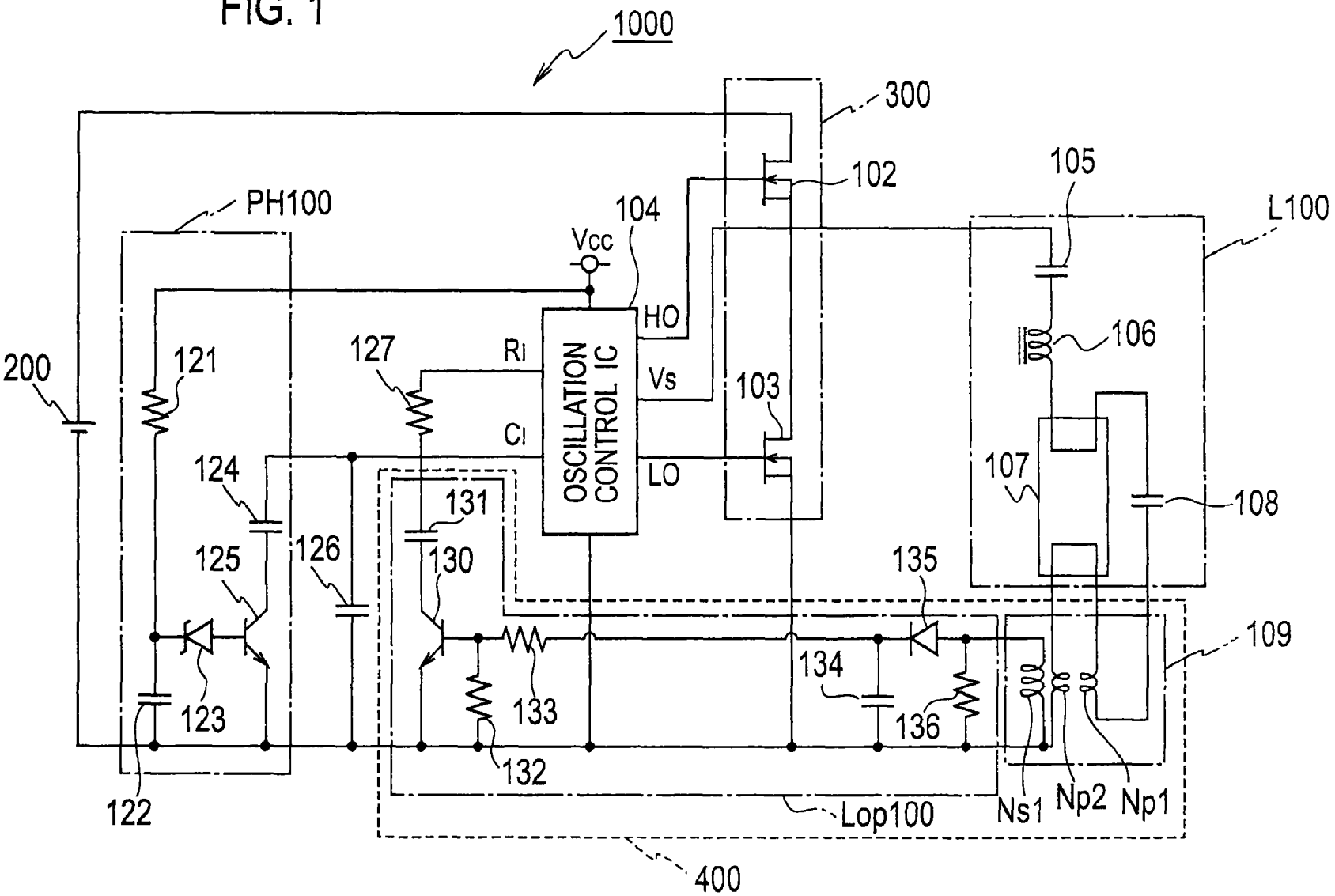
FIG. 1 is a circuit diagram illustrating a discharge lamp lighting apparatus according to a related art.
Figure 2:
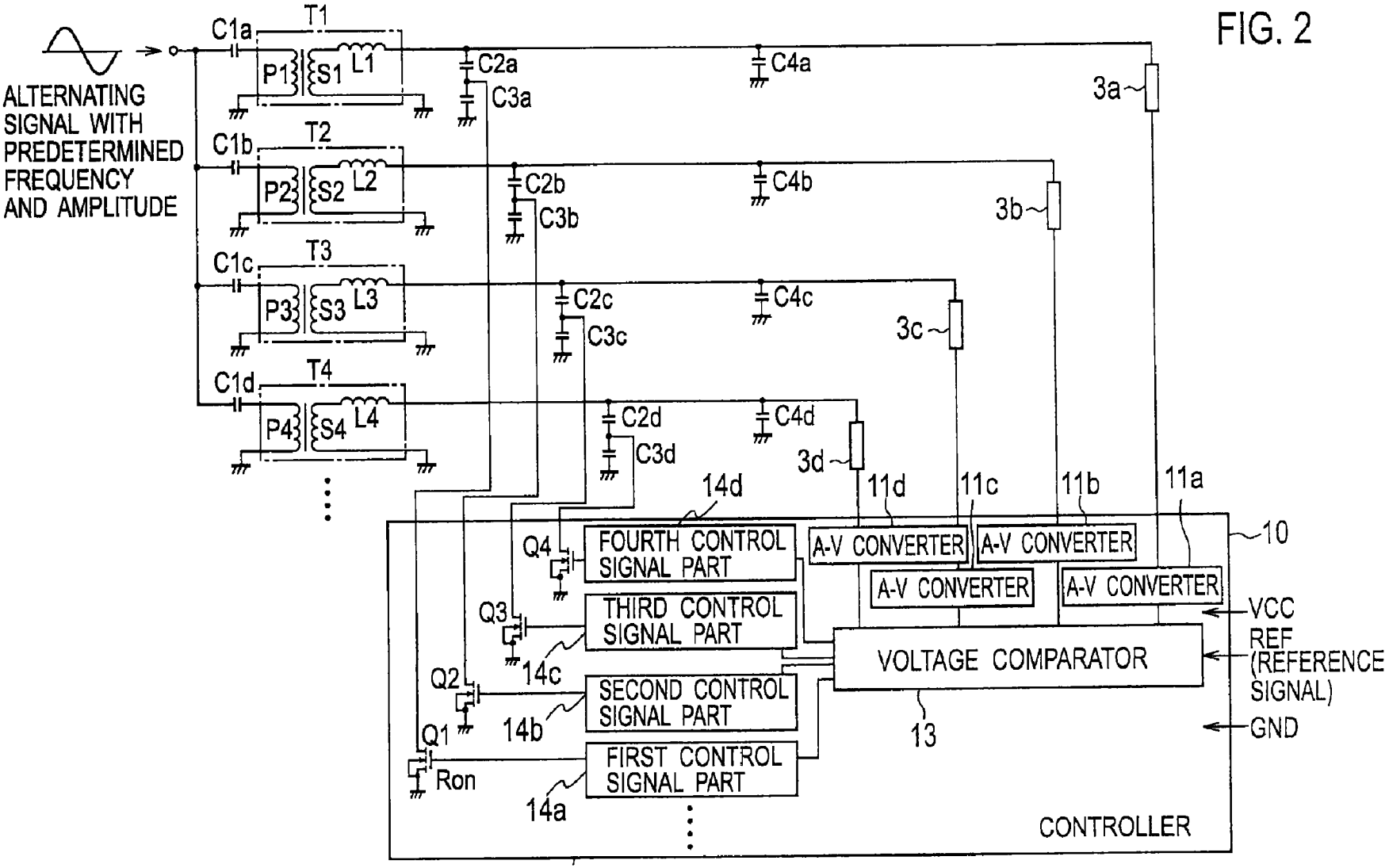
FIG. 2 is a circuit diagram illustrating a DC/AC converter according to an embodiment of the present invention.
Figure 3:
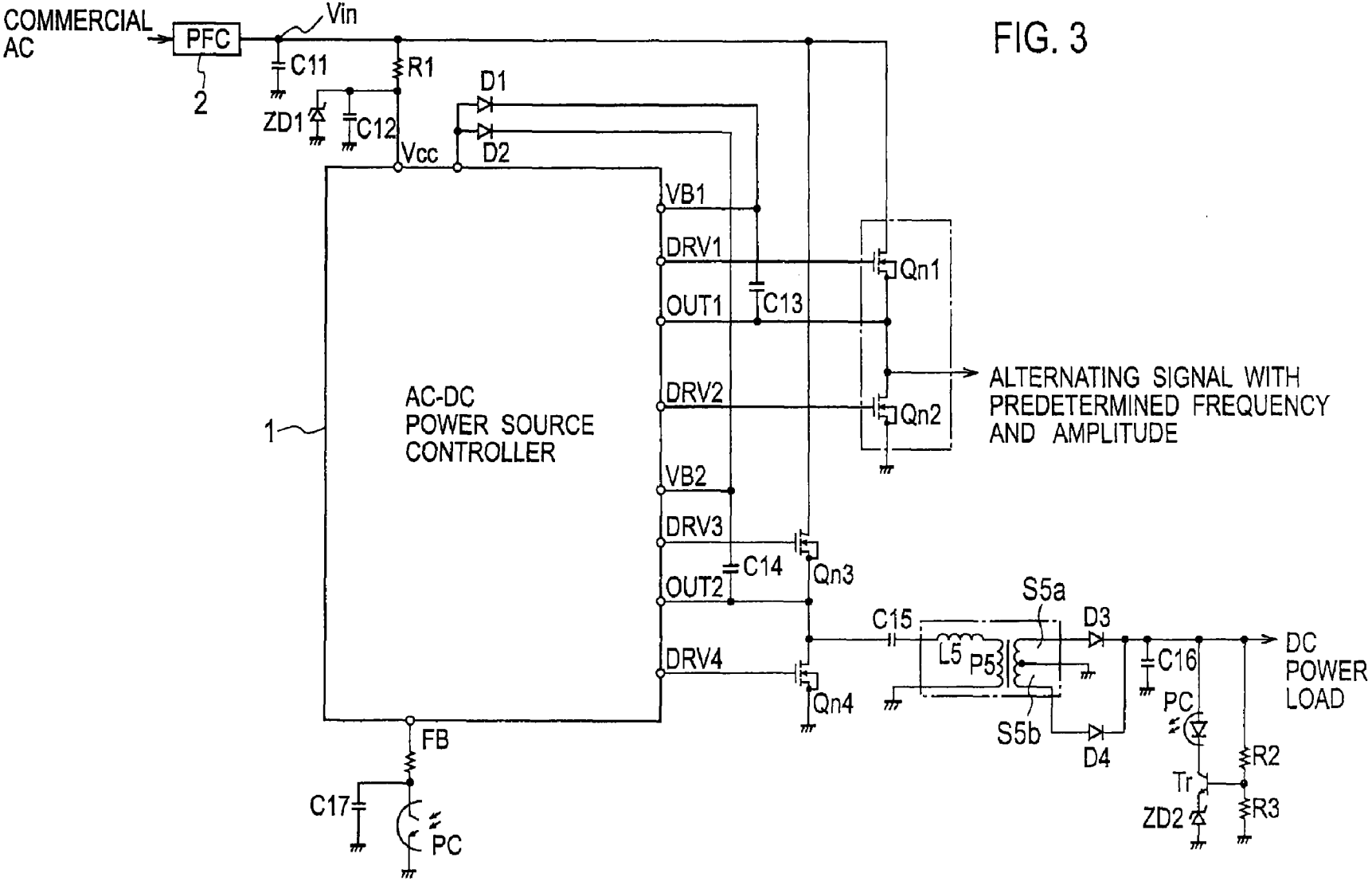
FIG. 3 is a circuit diagram illustrating an AC/DC converter and a DC/DC converter according to an embodiment of the present invention.

FIG. 2 is a circuit diagram illustrating the DC/AC converter according to an embodiment of the present invention. The DC/AC converter illustrated in FIG. 2 serves as a discharge lamp lighting apparatus. FIG. 3 is a circuit diagram illustrating an AC/DC converter and a DC/DC converter according to an embodiment of the present invention.

In the AC/DC converter illustrated in FIG. 3, a PFC (power factor corrector) 2 corrects the power factor of AC power from a commercial AC power source and the power-factor-corrected AC power is converted into DC power. The DC power is supplied to an AC-DC power source controller 1, n-type MOSFETs Qn1 and Qn2 as a switching network, and n-type MOSFETs Qn3 and Qn4 as a switching network.

An output end of the PFC 2 between a DC power source Vin and the ground is connected to a series circuit of the n-type MOSFETs Qn1 and Qn2 and a series circuit of the n-type MOSFETs Qn3 and Qn4.

The n-type MOSFET Qn1 has a drain connected to the DC power source Vin and a gate connected to a terminal DRV1 of the AC-DC power source controller 1. The n-type MOSFET Qn2 has a gate connected to a terminal DRV2 of the AC-DC power source controller 1.

Connected between a connection point of the n-type MOSFETs Qn3 and Qn4 and the ground is a series circuit including a capacitor C15, a primary winding P5 of a transformer T, and a reactor L5.

The n-type MOSFET Qn3 has a drain connected to the DC power source Vin and a gate connected to a terminal DRV3 of the AC-DC power source controller 1. The n-type MOSFET Qn4 has a gate connected to a terminal DRV4 of the AC-DC power source controller 1.

The transformer T has secondary windings S5*a* and S5*b* those are connected in series. A connection point of the secondary windings S5*a* and S5*b* is grounded. An end of the secondary winding S5*a* is connected to an anode of a diode D3 and an end of the secondary winding S5*b* is connected to an anode of a diode D4. A cathode of the diode D3, a cathode of the diode D4, an end of a capacitor C16, an anode of a diode of a photocoupler PC, and an end of a resistor R2 are commonly connected to supply DC power to a DC power load (not illustrated).

The resistor R2 and a resistor R3 are connected in series and a connection point thereof is connected to a base of a transistor Tr. The transistor Tr has a collector connected to a cathode of the diode of the photocoupler PC and an emitter grounded through a Zener diode ZD2.

The n-type MOSFETs Qn3 and Qn4, capacitors C15 and C16, transformer T, diodes D3 and D4, photocoupler PC, transistor Tr, Zener diode ZD2, and resistors R2 and R3 form a DC/DC converter.

In the DC/DC converter, a voltage corresponding to an output voltage of the capacitor C16 is sent through the diode of the photocoupler PC to a transistor of the photocoupler PC. According to a current passing through the transistor of the photocoupler PC, the AC-DC power source controller 1 controls ON/OFF of a switching drive signal that is a pulse signal. The switching drive signal is used to alternately turn on/off the n-type MOSFETs Qn3 and Qn4 and thereby control the DC output voltage of the capacitor C16 to a predetermined value.

The AC-DC power source controller 1 supplies the switching drive signal used to alternately turn on/off the n-type MOSFETs Qn3 and Qn4 to the n-type MOSFETs Qn1 and Qn2, to alternately turn on/off the n-type MOSFETs Qn1 and Qn2. Accordingly, a connection point of the n-type MOSFETs Qn1 and Qn2 outputs an alternating signal having a predetermined frequency and amplitude to four capacitors C1*a*, C1*b*, C1*c*, and C1*d* illustrated in FIG. 2.

The discharge lamp lighting apparatus, i.e., the DC/AC converter illustrated in FIG. 2 will be explained. This apparatus converts a direct current into an alternating current and supplies AC power to a load. The load is a discharge lamp, according to the embodiment.

In FIG. 2, an end of the capacitor C1*a* is grounded through a primary winding P1 of a transformer T1. A secondary winding S1 of the transformer T1 is connected through a reactor L1 to an end of a capacitor C2*a*, an end of a capacitor C4*a*, and a first electrode of a discharge lamp 3*a*. The other end of the capacitor C2*a* is grounded through a capacitor C3*a*. A connection point of the capacitors C2*a* and C3*a* is connected to a drain of a MOSFET Q1 serving as a variable impedance element.

An end of the capacitor C1*b* is grounded through a primary winding P2 of a transformer T2. A secondary winding S2 of the transformer T2 is connected through a reactor L2 to an end of a capacitor C2*b*, an end of a capacitor C4*b*, and a first electrode of a discharge lamp 3*b*. The other end of the capacitor C2*b* is grounded through a capacitor C3*b*. A connection point of the capacitors C2*b* and C3*b* is connected to a drain of a MOSFET Q2 serving as a variable impedance element.

An end of the capacitor C1*c* is grounded through a primary winding P3 of a transformer T3. A secondary winding S3 of the transformer T3 is connected through a reactor L3 to an end of a capacitor C2*c*, an end of a capacitor C4*c*, and a first electrode of a discharge lamp 3*c*. The other end of the capacitor C2*c* is grounded through a capacitor C3*c*. A connection point of the capacitors C2*c* and C3*c* is connected to a drain of a MOSFET Q3 serving as a variable impedance element.

An end of the capacitor C1*d* is grounded through a primary winding P4 of a transformer T4. A secondary winding S4 of the transformer T4 is connected through a reactor L4 to an end of a capacitor C2*d*, an end of a capacitor C4*d*, and a first electrode of a discharge lamp 3*d*. The other end of the capacitor C2*d* is grounded through a capacitor C3*d*. A connection point of the capacitors C2*d* and C3*d* is connected to a drain of a MOSFET Q4 serving as a variable impedance element.

The reactor L1 is a leakage inductance component of the transformer T1, the reactor L2 is a leakage inductance component of the transformer T2, the reactor L3 is a leakage inductance component of the transformer T3, and the reactor L4 is a leakage inductance component of the transformer T4.

Those elements form resonant circuits for the transformers T1, T2, T3, and T4, respectively.

A controller 10 (corresponding to the controller stipulated in the claims) for the DC/AC converter (discharge lamp lighting apparatus) has A-V converters 11*a*, 11*b*, 11*c*, and 11d, a voltage comparator 13 (corresponding to the comparator stipulated in the claims), first to fourth control signal parts 14*a*, 14*b*, 14*c*, and 14*d* (corresponding to the control part stipulated in the claims), and the MOSFETs Q1, Q2, Q3, and Q4.

The A-V converter 11*a* is connected to a second electrode of the discharge lamp 3*a*, to convert a current passed to the discharge lamp 3*a* into a first voltage and output the first voltage to the voltage comparator 13. The A-V converter 11*b* is connected to a second electrode of the discharge lamp 3*b*, to convert a current passing through the discharge lamp 3*b* into a second voltage and output the second voltage to the voltage comparator 13. The A-V converter 11*c* is connected to a second electrode of the discharge lamp 3*c*, to convert a current passing through the discharge lamp 3*c* into a third voltage and output the third voltage to the voltage comparator 13. The A-V converter 11*d* is connected to a second electrode of the discharge lamp 3*d*, to convert a current passing through the discharge lamp 3*d* into a fourth voltage and output the fourth voltage to the voltage comparator 13.

The voltage comparator 13 compares the first voltage from the A-V converter 11*a* with a reference signal (reference value) REF and finds a first error. The voltage comparator 13 compares the second voltage from the A-V converter 11*b* with the reference signal REF and finds a second error. The voltage comparator 13 compares the third voltage from the A-V converter 11*c* with the reference signal REF and finds a third error. The voltage comparator 13 compares the fourth voltage from the A-V converter 11*d* with the reference signal REF and finds a fourth error.

Figure 5:
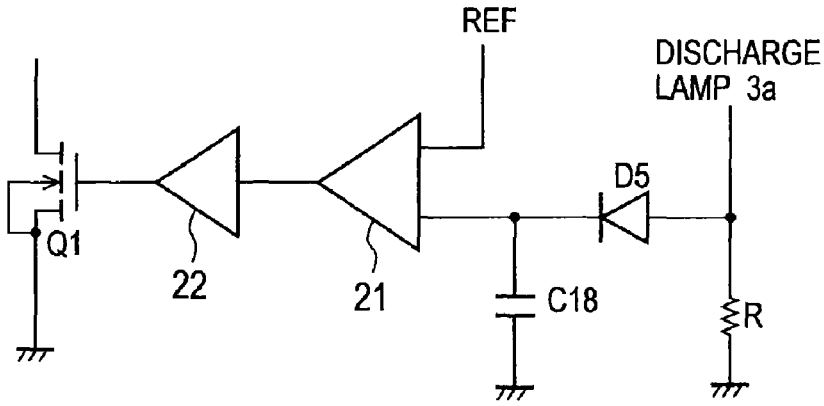
FIG. 5 is a circuit diagram illustrating a voltage comparator arranged in the discharge lamp lighting apparatus of FIG. 2.

FIG. 5 is a circuit diagram illustrating a configuration of the controller 10 arranged in the discharge lamp lighting apparatus of FIG. 2. The controller 10 of FIG. 5 illustrates only a part thereof to control a discharge current of the discharge lamp 3*a*.

In FIG. 5, a resistor R corresponds to the A-V converter 11*a* and is connected between a detection terminal TP (not illustrated) and the ground. The detection terminal TP detects an electric characteristic of the discharge lamp 3*a* serving as a load. The detection terminal TP and resistor R is the detection unit stipulated in the claims.

The electric characteristic detected by the detection terminal TP may be a current, a voltage, or an operation result such as an integration of current values. A connection point between a diode D5 and a capacitor C18 is connected to a non-inverting input terminal of an error amplifier 21. An inverting input terminal of the error amplifier 21 receives the reference signal REF. The diode D5, capacitor C18, error amplifier 21, and reference signal REF are the voltage comparator 13 and a part of the comparator stipulated in the claims.

An output terminal of the error amplifier 21 is connected through a buffer 22 corresponding to the first control signal part 14a to the MOSFET Q1. The MOSFETs Q2, Q3, and Q4 are each connected in the same manner. The other parts of the controller 10 for controlling discharge currents of the discharge lamps 3*b*, 3*c*, and 3*d* and the MOSFETs Q2, Q3, and Q4 are configured in a similar manner.

The first control signal part 14*a* generates a first control signal according to the first error provided by the voltage comparator 13. The first control signal changes the impedance value of the MOSFET Q1, to change the resonant frequency of the resonant circuit having C1*a*, L1, C2*a*, C3*a*, C4*a*, Ron1, and RL1 and thereby control the current passing through the discharge lamp 3*a* to a predetermined value.

The second control signal part 14*b* generates a second control signal according to the second error provided by the voltage comparator 13. The second control signal changes the impedance value of the MOSFET Q2, to change the resonant frequency of the resonant circuit having C1*b*, L2, C2*b*, C3*b*, C4*b*, Ron2, and RL2 and thereby control the current passing through the discharge lamp 3*b* to the predetermined value.

The third control signal part 14*c* generates a third control signal according to the third error provided by the voltage comparator 13. The third control signal changes the impedance value of the MOSFET Q3, to change the resonant frequency of the resonant circuit having C1*c*, L3, C2*c*, C3*c*, C4*c*, Ron3, and RL3 and thereby control the current passing through the discharge lamp 3*c* to the predetermined value.

The fourth control signal part 14*d* generates a fourth control signal according to the fourth error provided by the voltage comparator 13. The fourth control signal changes the impedance value of the MOSFET Q4, to change the resonant frequency of the resonant circuit having C1*d*, L4, C2*d*, C3*d*, C4*d*, Ron4, and RL4 and thereby control the current passing through the discharge lamp 3*d* to the predetermined value.

Operation of the discharge lamp lighting apparatus (DC/AC converter) according to the embodiment illustrated in FIG. 2 will be explained.

Figure 4:
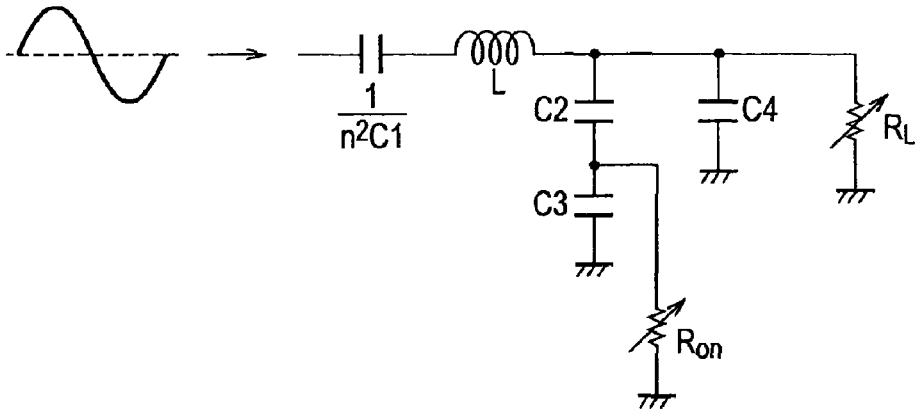
FIG. 4 is an equivalent circuit diagram illustrating a resonant circuit arranged in the discharge lamp lighting apparatus of FIG. 2.

FIG. 4 illustrates an equivalent circuit of the resonant circuit arranged in the discharge lamp lighting apparatus of FIG. 2. The equivalent circuit illustrated in FIG. 4 represents one of the resonant circuits arranged for the transformers T1, T2, T3, and T4 and includes a capacitor $1/n^2$C1, a reactor L, capacitors C2, C3, and C4, a variable resistor Ron, and a resistor RL of the discharge lamp 3 that changes a resistance value according to a lamp current.

The capacitor $1/n^2$C1 is on the secondary side of the transformer T1 (T2, T3, T4) and is converted from the capacitor C1 on the primary side of the transformer. The variable resistor Ron is formed by the variable impedance element of the present invention, i.e., the MOSFET Q1 (Q2, Q3, Q4) whose resistance varies according to the first (second, third, fourth) control signal provided by the first (second, third, fourth) control signal part 14*a* (14*b*, 14*c*, 14*d*).

An equivalent composite impedance Z of the resonant circuit illustrated in FIG. 4 is expressed as follows:

$$Z=j\omega\{L_1-1/(n^2C_1)\}+A(B-C)/(A+B-C)$$

$$A=(1-j\omega RLC_4)RL/(1+\omega^2RL^2C_4^2)$$

$$B=(1-j\omega \mathrm{Ron}C_3)Ron/(1+\omega^2\mathrm{Ron}^2C_3^2)$$

$$C=j/(\omega C_2)$$

Accordingly, changing the constant of the variable resistor Ron results in equivalently changing the resonant frequency (a frequency whose imaginary root is zero) of the resonant circuit. The constant of the variable resistor Ron is changed according to a current passing through the discharge lamp 3*a* (3*b*, 3*c*, 3*d*).

As an example, controlling a current passing through the discharge lamp 3*a* to a constant value will be explained. Controlling currents passing through the other discharge lamps 3*b*, 3*c*, and 3*d* is similarly carried out.

The A-V converter 11*a* converts a current passing through the discharge lamp 3*a* into a voltage. In the voltage comparator 13 illustrated in FIG. 5, the voltage from the A-V converter

11*a* is inputted through the diode D5 into the non-inverting input terminal of the error amplifier 21.

The error amplifier 21 amplifies an error between the voltage from the A-V converter 11*a* and the reference signal REF and outputs the amplified error signal to the buffer 22. The buffer 22 outputs the amplified error signal to the MOSFET Q1. Consequently, the variable resistor Ron that is a resistance component between the drain and source of the MOSFET Q1 changes according to the current passing through the discharge lamp 3*a*.

Figure 6:
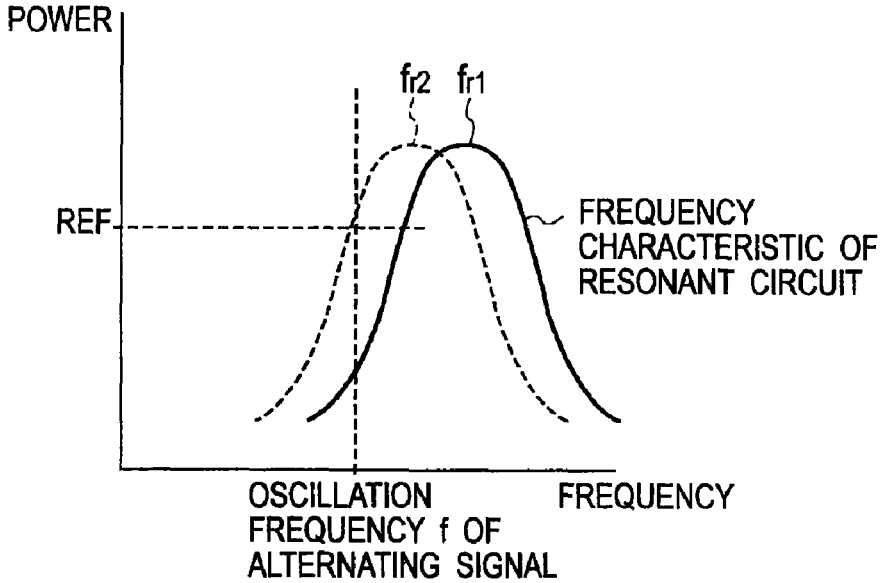
FIG. 6 is a graph explaining a technique of controlling the resonant frequency of the resonant circuit arranged in the discharge lamp lighting apparatus of FIG. 2.

A method of controlling the resonant frequency of the resonant circuit will be explained with reference to FIG. 6 that illustrates a relationship between the frequency of the resonant circuit and power supplied to the discharge lamp. In the following explanation, an assumption is made that the resonant frequency fr1 of the resonant circuit is larger than the oscillation frequency f of the alternating signal supplied to the resonant circuit and power supplied to the discharge lamp is smaller than power corresponding to the reference signal REF.

In such a case, the power supplied to the discharge lamp 3*a* is smaller than the case in which the oscillation frequency f and resonant frequency fr1 are equal to each other. Since a current passing through the discharge lamp 3*a* is lower than a current corresponding to the reference signal REF, the error amplifier 21 supplies an output voltage representative of the error to the gate of the MOSFET Q1 serving as the variable resistor Ron.

If the error between the current passed to the discharge lamp 3*a* and the current corresponding to the reference signal REF is large, the voltage from the error amplifier 21 applied to the gate of the MOSFET Q1 becomes larger to reduce the variable resistance Ron and decrease the resonant frequency of the resonant circuit. For example, the resonant frequency fr1 of the resonant circuit decreases to fr2 as illustrated in FIG. 6, to increase power supplied to the discharge lamp 3*a* close to the power corresponding to the reference signal REF. Even if the oscillation frequency f of the alternating signal supplied to the resonant circuit is fixed, power supplied to the discharge lamp 3*a* can be brought close to the predetermined power corresponding to the reference signal REF.

In this way, the controller 10 arranged in the discharge lamp lighting apparatus (DC/AC converter) according to the embodiment changes the resonant frequency of each resonant circuit according to a changed impedance value of the MOSFET Q1 (Q2, Q3, Q4) as the variable impedance element, to thereby control a current passing through the discharge lamp 3*a* (3*b*, 3*c*, 3*d*) at a predetermined value. Namely, the embodiment changes the resonant frequency of the resonant circuit to control power required by the discharge lamp 3*a* (3*b*, 3*c*, 3*d*), and therefore, the switching elements Qn1 and Qn2 can simply operate at a predetermined frequency and duty without arranging an exclusive PWM feedback controller for the switching elements Qn1 and Qn2.

Accordingly, the switching drive signal of the half-bridge-type AC-DC power source (FIG. 3) used to supply DC power through the DC/DC converter (FIG. 3) to, for example, a microcomputer that is imperative for an LCD system is commonly usable for the discharge lamp lighting apparatus, i.e., the DC/AC converter of FIG. 2, to greatly simplify the controller 10. As results, the DC/AC converter according to the embodiment is compact and low cost.

If the resistance component to change the resonant frequency of the resonant circuit is inserted in series with the discharge lamp 3*a* (3*b*, 3*c*, 3*d*), a loss in effective power will increase. To cope with this, the discharge lamp lighting apparatus according to the embodiment changes an equivalent component of the capacitor C3*a* (C3*b*, C3*c*, C3*d*) connected in parallel with the discharge lamp 3*a* (3*b*, 3*c*, 3*d*), to carry out apparent power control. Accordingly, the discharge lamp lighting apparatus (DC/AC converter) according to the embodiment is capable of efficiently lighting the discharge lamps.

The DC/AC converter according to the embodiment is applicable not only to discharge lamps serving as load in the embodiment but also to various AC loads. The alternating signal having a predetermined frequency and amplitude is not limited to that based on the switching drive signal of the AC-DC power source. It may be based on a drive signal of a switching power source apparatus that is electrically in parallel with the DC/AC converter of the present invention.

This application claims benefit of priority under 35 USC §119 to Japanese Patent Application No. 2008-239555, filed on Sep. 18, 2008, the entire content of which is incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A DC/AC converter comprising:

a resonant circuit having a first capacitor connected to at least one of primary and secondary windings of a transformer and an output end connected to a load, the resonant circuit being configured to receive an alternating signal having a predetermined frequency and amplitude to supply a current;

a variable impedance element connected in parallel with a part of the output end of the resonant circuit, the variable impedance element being configured to change the impedance value thereof according to a current passing through the load; and a controller configured to control the current passing through the load at a predetermined value by controlling the resonant frequency of the resonant circuit according to the impedance value of the variable impedance element.

2. The DC/AC converter of claim 1, wherein:

the resonant circuit is a series resonant circuit that demonstrates a strong resonant characteristic on the secondary winding side of the transformer; and the resonant circuit includes a second capacitor connected in parallel with the variable impedance element, and end of the second capacitor is grounded.

3. The DC/AC converter of claim 1, wherein:

the variable impedance element is a semiconductor element; and the controller changes the impedance value of the semiconductor element according to an error between the current passing through the load and the predetermined value and changes the resonant frequency of the resonant circuit according to the impedance value, thereby controlling the current passing through the load at the predetermined value.

4. The DC/AC converter of claim 1, further comprising a plurality of switching elements connected between ends of a DC power source and configured to turn on/off in response to a drive signal having a predetermined frequency and duty and thereby generate the alternating signal having a predetermined frequency and amplitude.

5. The DC/AC converter of claim 4 further comprising a DC/DC converter configured to convert a direct current into another direct current according to a switching drive signal that is used as the drive signal having a predetermined frequency and duty.

6. A controller for a DC/AC converter, comprising:

a detection unit configured to detect an electric characteristic of a load;

a comparator configured to compare the detected electric characteristic with a reference value and find an error between them;

a variable impedance element connected in parallel with a part of an output end of a resonant circuit that includes a transformer and capacitors, the output end of the resonant circuit being connected to the load; and a control part configured to control the impedance value of the variable impedance element according to the error provided by the comparator, change the resonant frequency of the resonant circuit according to the changed impedance value, and thereby control a current passing through the load to a predetermined value.

7. The DC/AC converter of claim 1, wherein the load is a discharge lamp.

* * * * *